US006775869B2

(12) United States Patent
Cohen

(10) Patent No.: US 6,775,869 B2
(45) Date of Patent: Aug. 17, 2004

(54) BOTTLE OPENER

(76) Inventor: Wayne Cohen, 44 Convent Road, Silom Bangrak, Bangkok (TH), 10500

( * ) Notice: Subject to any disclaimer, the term of this patent is extended or adjusted under 35 U.S.C. 154(b) by 0 days.

(21) Appl. No.: 09/865,349

(22) Filed: May 25, 2001

(65) Prior Publication Data

US 2002/0166176 A1 Nov. 14, 2002

Related U.S. Application Data

(60) Provisional application No. 60/289,938, filed on May 9, 2001.

(51) Int. Cl.[7] ..... B67B 7/00; B67B 7/16

(52) U.S. Cl. ..... 7/151; 81/3.09; 81/3.55

(58) Field of Search ..... 7/151, 170; 81/3.07, 81/3.09, 3.55, 3.57; D8/34, 38; 84/402, 404

(56) References Cited

U.S. PATENT DOCUMENTS

| | | | | | |
|---|---|---|---|---|---|
| 1,880,985 | A | * | 10/1932 | Saunders | 81/3.09 |
| 2,016,513 | A | * | 10/1935 | Pollock | 81/3.35 |
| 4,560,344 | A | * | 12/1985 | Kietaibl | 7/151 |
| 4,864,898 | A | | 9/1989 | Tricinella | 81/3.09 |
| 5,169,305 | A | * | 12/1992 | Kee | 7/151 |
| 5,483,859 | A | * | 1/1996 | Singer | 84/322 |
| D421,372 | S | * | 3/2000 | Wysopal | D8/38 |
| 6,056,464 | A | * | 5/2000 | Cohen | 401/52 |
| D428,298 | S | * | 7/2000 | Cohen | D7/300.2 |
| D429,942 | S | * | 8/2000 | Cohen | D7/300.2 |
| D437,885 | S | * | 2/2001 | Cohen | D19/36 |
| D439,816 | S | * | 4/2001 | Wysopal | D8/38 |

FOREIGN PATENT DOCUMENTS

| | | | | |
|---|---|---|---|---|
| FR | 45006/684.613 | * | 6/1950 | 81/3.57 |

* cited by examiner

*Primary Examiner*—James G. Smith
(74) *Attorney, Agent, or Firm*—Baker Botts L.L.P.

(57) ABSTRACT

A maraca is formed with a handle having a bottle opener therein. A transverse groove is provided in the handle which has a bottom surface, a first side surface, and second side surface. A metal tool is mounted in the handle to extend along the first side surface, and to extend from the first side surface toward the second side surface.

65 Claims, 6 Drawing Sheets

BOTTLE OPENER

This application claims the benefit of Provisional Application No. 60/289,938 filed May 9, 2001.

BACKGROUND OF THE PRESENT INVENTION

This invention relates to bottle openers. One known bottle opener, which may be attached to a key chain is described in U.S. Pat. No. 4,864,898. This conventional bottle opener includes a body made of a polyamide, such as nylon, which may be fiber filled for added strength and rigidity. A steel edge gripper tool, for use in opending bottle, is joined to the body.

It is an object of the present invention to provide a bottle opener which may, for example, be incorporated into the handle of another item, such as a maraca.

SUMMARY OF THE PRESENT INVENTION

In accordance with the present invention, there is provided a maraca which includes a shell with enclosed pallets and a cylindrical member. The cylindrical member includes an outer surface forming the handle, a groove extending transversely across the handle, and a metal tool. The groove includes a first side surface, a second side surface, a bottom surface, and a transverse slot having closed ends and formed into the cylindrical member from the bottom surface. The metal tool is a metal tool fixed in the slot having a shaped web which includes a first web portion extending along the first side surface, and a second web portion extending outwardly from the first side surface, configured to engage a bottle cap.

In accordance with another aspect of the present invention, there is provided a bottle opener which includes a substantially cylindrical member. The substantially cylindrical member includes an outer surface forming a handle having a first end and a second end, a groove, located near the second end, extending transversely across the handle, and a metal tool, configured to engage a bottle cap. The groove has a first side surface, a second side surface, a bottom surface, and a transverse slot which includes closed ends and formed into the cylindrical member from the bottom surface. The metal tool having a first portion extending along the first side surface, and a second portion extending outward from the first side surface configured to engage a bottle cap.

For a better understanding of the present invention, together with other and further objects thereof, reference is made to the following description, taken in conjunction with the accompanying drawings, and its scope will be pointed out in the appended claims.

BRIEF DESCRIPTION OF THE DRAWING

Further objects, features, and advantages of the present invention will become apparent from the following detailed description taken in conjunction with the accompanying figures showing illustrative embodiments of the present invention, in which.

Figure 1:
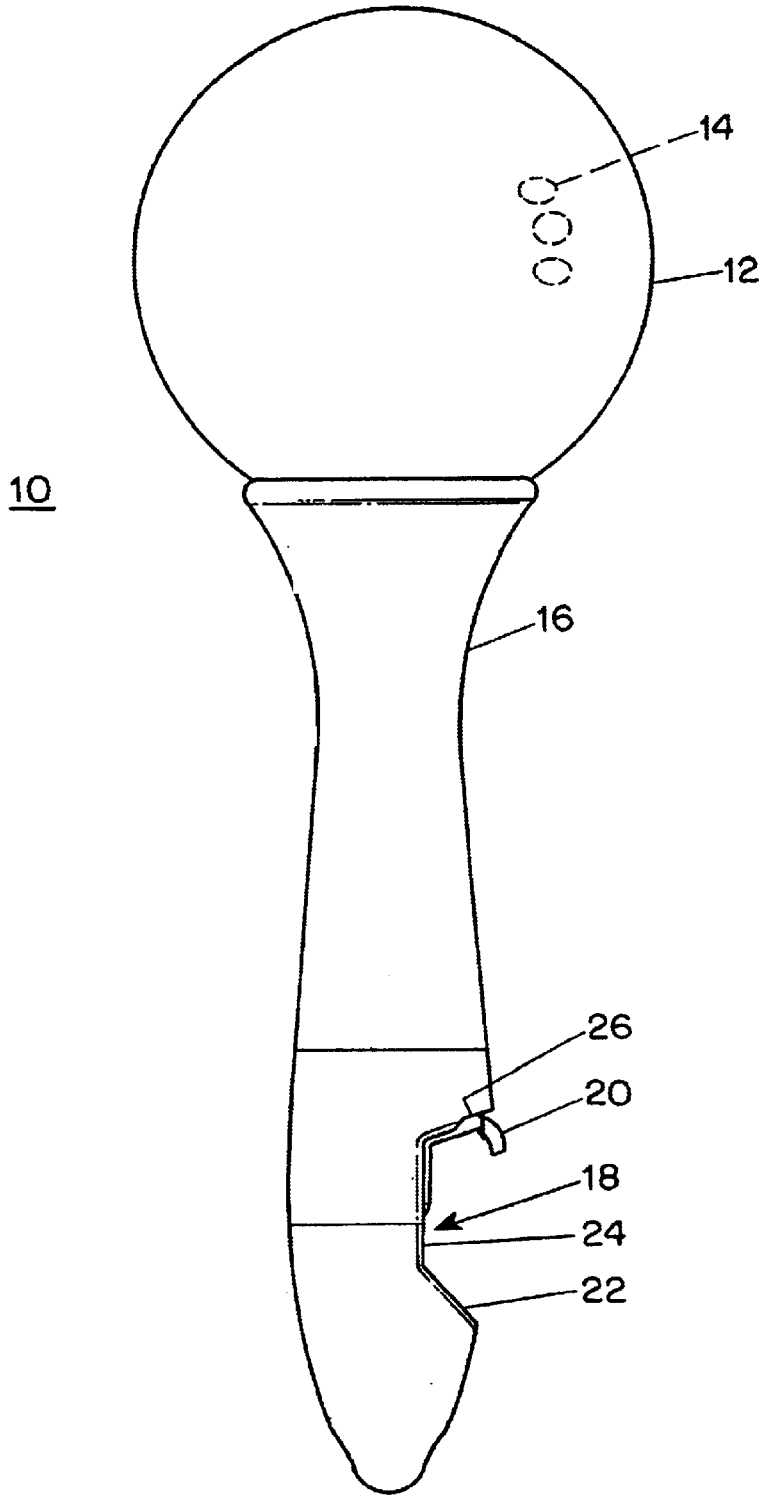
FIG. 1 is an elevation view of a first exemplary embodiment of a maraca in accordance with the present invention.

Throughout the figures, unless otherwise stated, the same reference numerals and characters are used to denote like features, elements, components, or portions of the illustrated embodiments. Moreover while the subject invention will now be described in detail with reference to the figures, and in connection with the illustrative embodiments, changes and modifications can be made to the described embodiments without departing from the true scope and spirit of the present invention as defined by the appended claims.

DESCRIPTION OF THE PRESENT INVENTION

FIG. 1 shows a maraca 10 in accordance with a first embodiment of the present invention. The maraca 10 includes a shell 12 which is preferably made of plastic or similar material and encloses pellets 14 for providing a rattle-type sound. The maraca 10 includes a handle 16 which is generally cylindrical, and has a tapered shape including a wide portion for gripping by the hand of a user. The wide portion of cylindrical handle 16 is provided with a transverse groove 18 formed therein. The groove 18 includes a bottom grooved surface 24, a first side surface 26 and a second side surface 22. A metal tool 20 is mounted within groove 18, and arranged to engage the edge of a bottle cap for opening a bottle.

The second side surface 22 forms an interior angle from the bottom surface 24 of approximately 145°. Likewise the first side surface 26 forms an interior angle with the bottom surface 24 which may be greater than 90°, and preferably approximately 115°.

Figure 2:
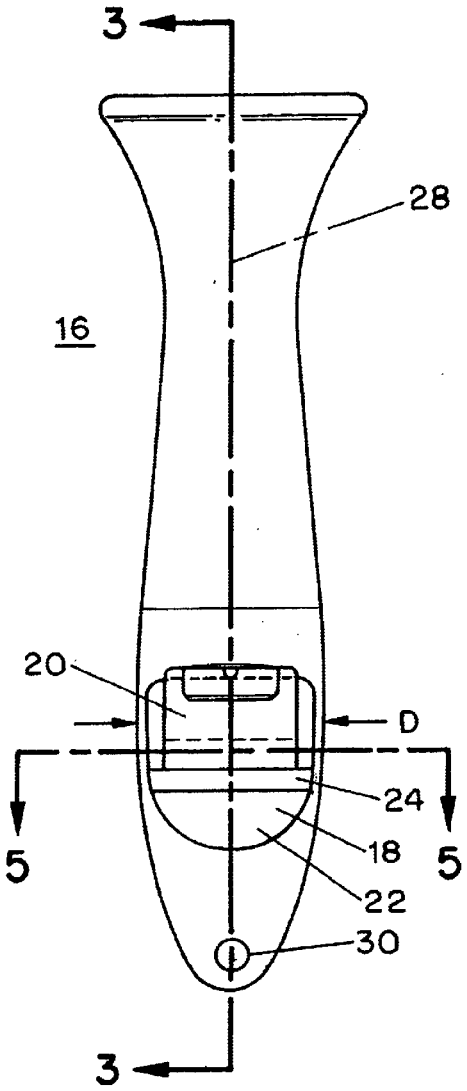
FIG. 2 is an elevation view of the front of the handle of the maraca shown in FIG. 1.

FIG. 2 is a front view of the cylindrical handle 16 of the maraca 10 of FIG. 1. The maraca handle 16 includes a central axis 28. The bottom surface 24 of groove 18 is preferably substantially planar, and preferably parallel to the central axis 28. The enlarged portion of the cylindrical handle 16 has a diameter D which is approximately 15 millimeters. A bore 30 can be provided at the end of handle 16, and may be used to attach the maraca 10 as an ornament to a key chain.

Figure 3:
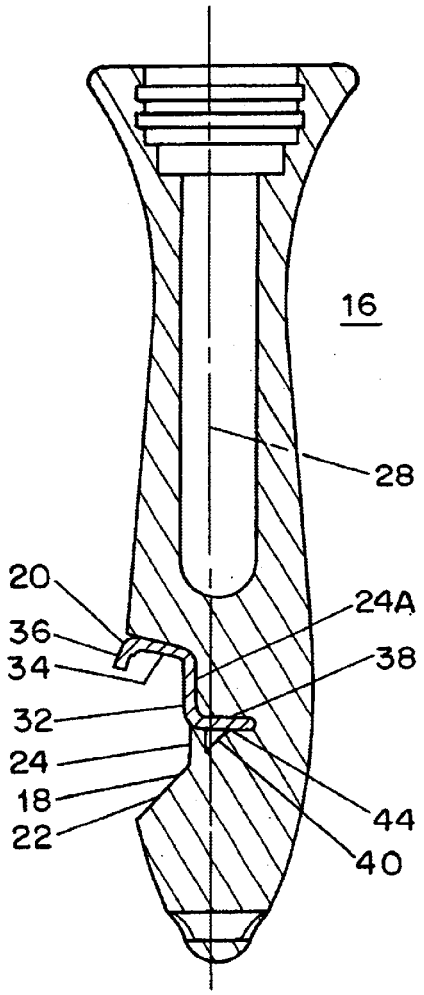
FIG. 3 is a cross sectional view of the handle of the maraca shown in FIG. 1.

FIG. 3 provides a cross-sectional view of the cylindrical handle along the line 3—3. In FIG. 3 the metal tool 20 is mounted within the groove 18 of the cylindrical handle 16. The metal tool 20 is described in greater detail below with reference to FIG. 4. The metal tool 20 includes a first web portion 32, a second web portion 34, a third web portion 36, and a fourth web portion 38. The fourth web portion 38 of the metal tool 20 is driven into a slot 44 formed in the cylindrical handle 16. The slot 44 is substantially perpendicular to the central axis 28. The fourth web portion 38 of the metal tool 20 is inserted into the slot 44 until the first web portion 32 comes in contact with an undercut 24A of the surface 24. The undercut 24A is formed in surface 24 to accommodate the cooperation with the metal tool 20. A portion 40 of the fourth web portion 38 may be pressed out to form a tooth for engaging the interior of slot 44, and to retain the metal tool 20 therein.

Figure 4:
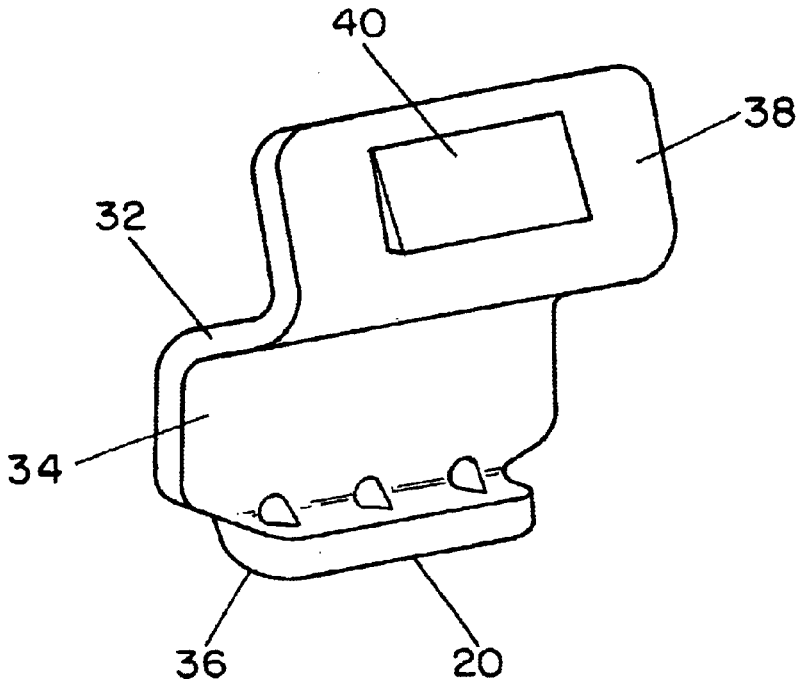
FIG. 4 is a first exemplary embodiment of a metal tool used in connection with the maraca shown in FIG. 1.

FIG. 4 provides a perspective view of the metal tool 20. The metal tool 20 is made of a metallic web, preferably steel, such as stainless steel or harden steel plated with chromium. The first web portion 32 lies against surface 24, preferably in an undercut 24A in surface 24. The second web portion 34 lies against the first side surface 26 of groove 18. The third web portion 36 extends outwardly from web portion 34 toward second side surface 22 as shown in FIG. 3. The third web portion 36 is configured to engage with an underside of the bottle cap. The fourth web portion 38 extends from the first web portion 32 at the opposite end thereof, and is configured to be received in the slot 44 formed in the handle 16.

Figure 5:
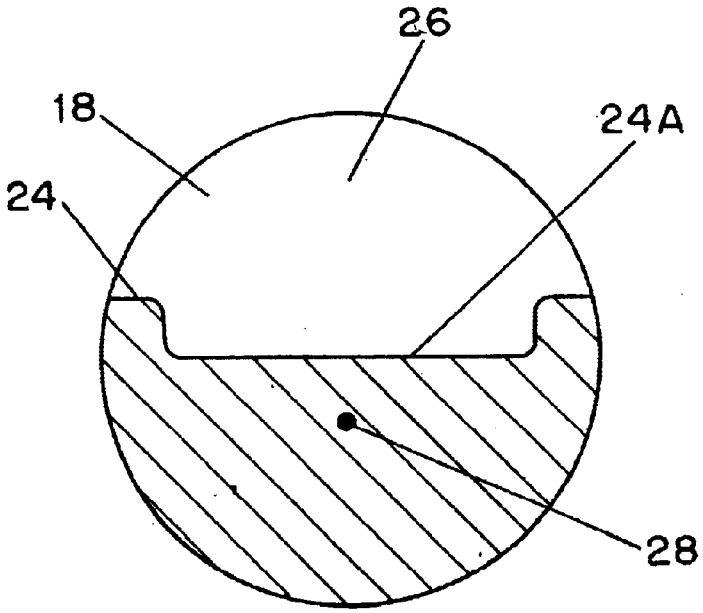
FIG. 5 is a front cross-sectional view of an area of the maraca shown in FIG. 1 (e.g. and undercut) which is provided for placing the metal tool shown in FIG. 4 therein.

FIG. 5 provides a cross-sectional view of the cylindrical handle along the line 5—5 of FIG. 2. In FIG. 5 the metal tool 20 is not yet mounted within the groove 18 of the cylindrical handle 16 for the purpose of describing this section in further detail. The undercut 24A is formed in the surface 24 to accommodate the metal tool 20. The undercut 24A is preferably substantially planar and preferably parallel to the central axis 28. The undercut 24A is closer to the axis 28 of the cylindrical handle 16 than the surface 24. The first side surface 26 of the groove 18 is in contact with one end of the surface 24.

Figure 6:
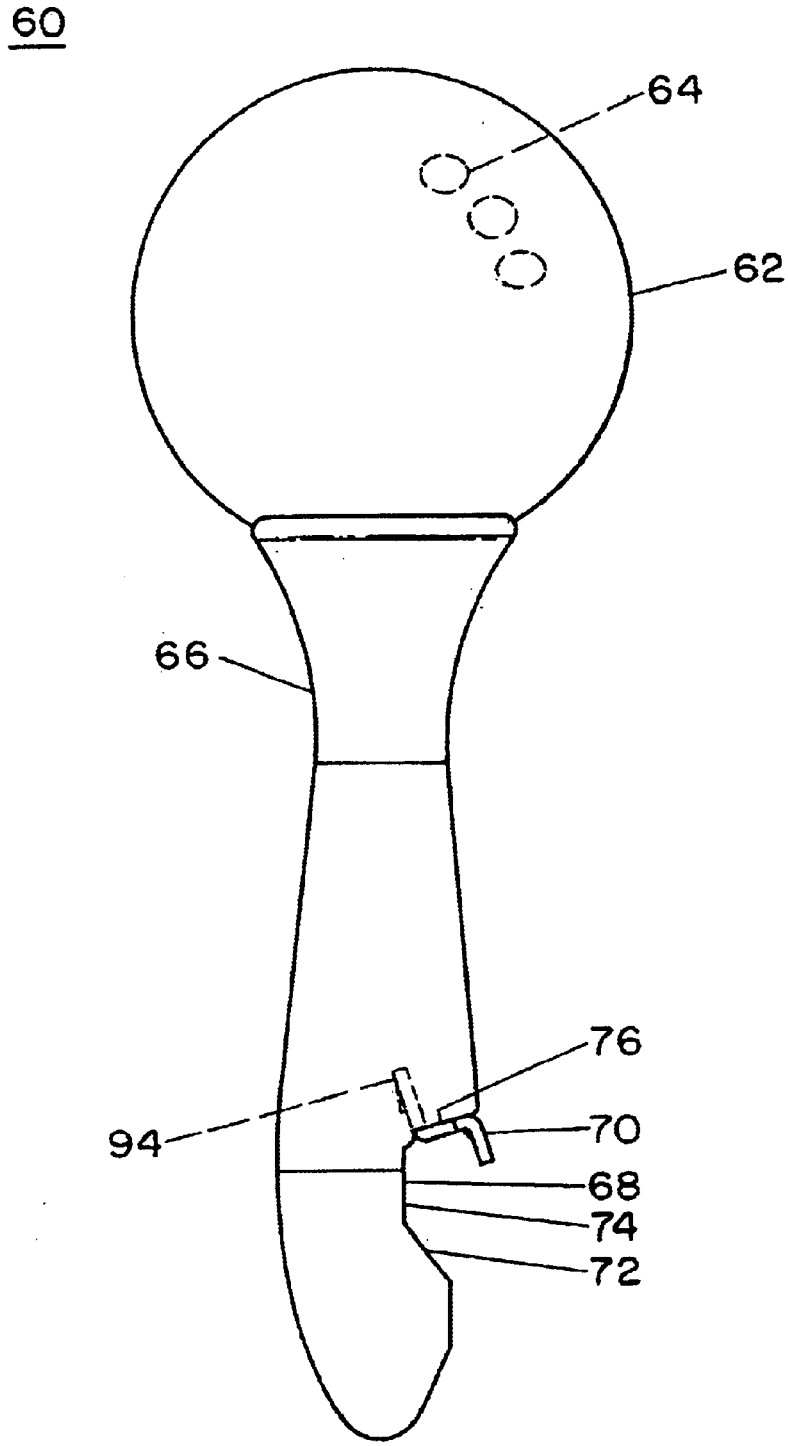
FIG. 6 is a second exemplary embodiment of the maraca.

Referring to FIG. 6, there is shown a maraca 60 in accordance with a second embodiment of the present invention. The maraca 60 includes a shell 62 which is preferably made of plastic or similar material and encloses pellets 64 for providing a rattle type sound. The maraca 60 includes a handle 66 which is generally cylindrical, and has a tapered shape including a wide portion for gripping by the hand of a user. The wide portion of cylindrical handle 66 is provided with a transverse groove 68 formed therein. The groove 68 includes a bottom grooved surface 74, a first side surface 76 and a second side surface 72. A metal tool 70 is mounted within groove 68, and arranged to engage the edge of a bottle cap for opening a bottle.

The second side surface 72 forms an interior angle from the bottom surface 74 of approximately 145°. Likewise the first side surface 76 forms an interior angle with the bottom surface 74 which may be greater than 90°, and preferably approximately 115°.

Figure 7:
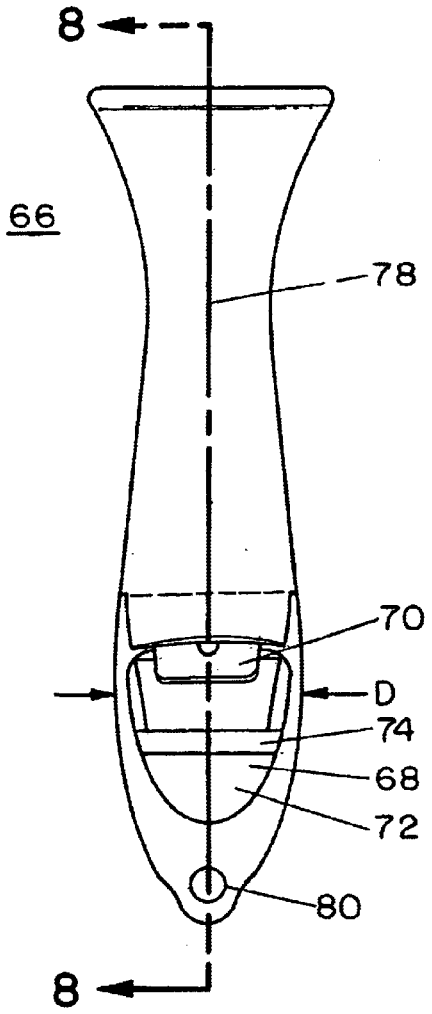
FIG. 7 is an elevation view of the handle of the maraca shown in FIG. 6.

FIG. 7 is a front view of the cylindrical handle 66 of the maraca 60 of FIG. 6. The cylindrical handle 66 includes a central axis 78. The bottom surface 74 of groove 68 is preferably substantially planar, and preferably parallel to the central axis 78. The enlarged portion of the cylindrical handle 66 has a diameter D which is approximately 15 millimeters. A bore 80 is provided at the end of the handle 66, and may be used to attach the maraca 60 as an ornament to a key chain.

Figure 8:
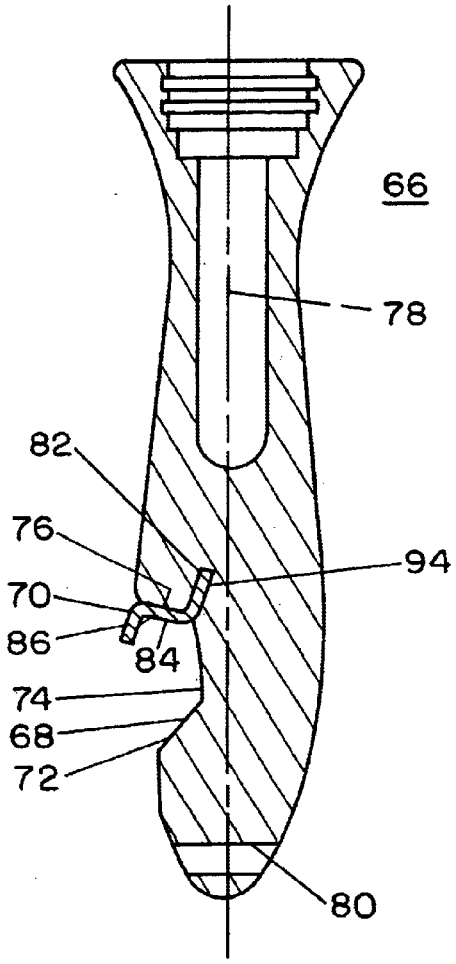
FIG. 8 is a cross-sectional view of the handle of the maraca shown in FIG. 6.

FIG. 8 provides a cross-sectional view of the cylindrical handle along the line 8—8. In particular, FIG. 8 shows that the metal tool 70 is mounted within the groove 68 of the cylindrical handle 66. The metal tool 70 is described in greater detail below with reference to FIGS. 9 and 10. The metal tool 70 includes a first web portion 84, a second web portion 86, and a third web portion 82. The third web portion 82 of the metal tool 70 is driven into a slot 94 formed in the cylindrical handle 66. The slot 94 may extend at a slight angle from or can be substantially parallel to the central axis 78. The slot 94 can extend from the juncture of the bottom grooved surface 74 and the first side surface 76 towards the shell 62 and a center of the handle 66. The third web portion 82 of the metal tool 70 can be inserted into the slot 94 until the first web portion 84 comes in contact with the first side surface 76. Two portions 90, 92 of the third web portion 82 (shown in FIG. 9) are pressed out to form a teeth for engaging the interior of slot 94, and to retain the metal tool 70 therein.

Figure 9:
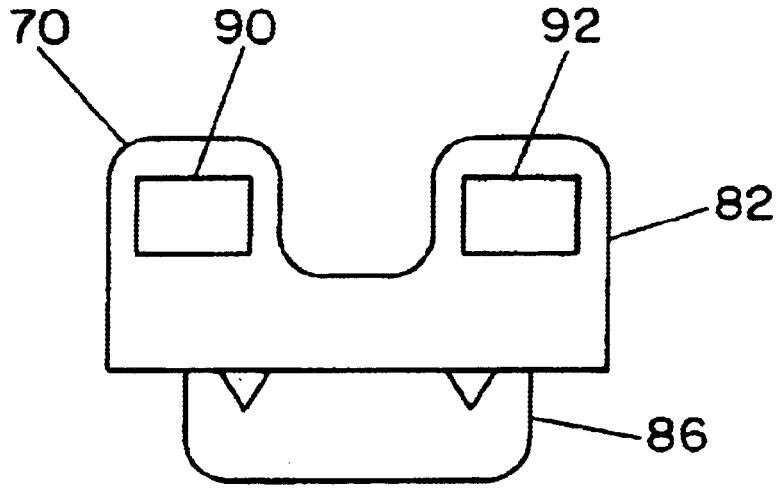
FIG. 9 is a front view of a second exemplary embodiment of the metal tool used in connection with the maraca shown in FIG. 6.

The details of the metal tool 70 are provided in FIG. 9 which shows a front view thereof. The metal tool 70 is made of a metallic web, preferably steel, such as stainless steel or harden steel plated with chromium. The third web portion 82 of the metal tool 70 extends from the first web portion 84, and is arranged to be received in the slot 94 formed in the handle 66. Two portions 90, 92 of the third web portion 82 are pressed out to form teeth for engaging the interior of the slot 94, and retaining the metal tool 70 therein.

Figure 10:
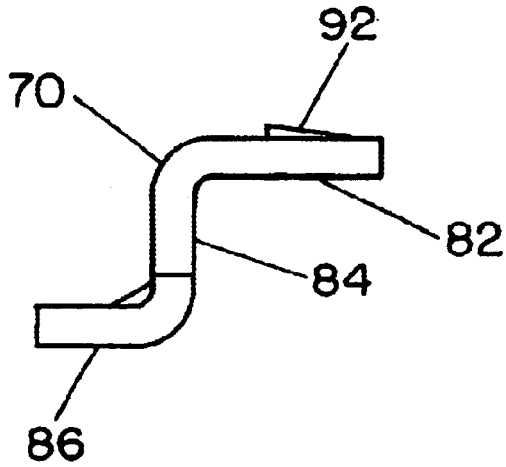
FIG. 10 is a side view of the metal tool shown in FIG. 9.

FIG. 10 provides a side view of the metal tool 70, in which the first web portion 84 lies against the first side surface 76. The second web portion 86 extends outwardly from the first web portion 84 at the opposite end thereof, from the third web portion 82, as is illustrated in FIG. 8. The second web portion 86 is configured with an underside of the bottle cap.

While there has been described what is believed to be the preferred embodiment of the present invention, those skilled in the art will recognize the other and further changes and modifications may be made thereto without departing from the spirit of the present invention and it is intended to claim all such changes as for within the true scope of the present invention.

What is claimed is:

1. A maraca comprising:

a shell with pellets therein;

a substantially cylindrical member having an outer surface which forms a handle, the handle including:

a groove extending transversely across the handle, the groove including a first side surface, a second side surface, a bottom surface, and a transverse slot, the transverse slot being formed into the cylindrical member; and a metal tool fixed in the groove, the metal tool including:

a first portion extending along the first side surface of the groove, and a second portion extending outwardly from the first side surface of the groove, and configured to engage a bottle cap.

2. The maraca of claim 1, wherein the metal tool comprises a third portion extending from the first side surface along the bottom surface of the groove.

3. The maraca of claim 1, wherein the metal tool comprises a fourth portion extending from the bottom side surface, the fourth portion being received in the transverse slot.

4. The maraca of claim 3, wherein the transverse slot is formed approximately perpendicular to a longitudinal axis of the cylindrical member.

5. The maraca of claim 1, wherein the metal tool comprises a third portion extending from the first side surface and being received in the transverse slot.

6. The maraca of claim 5, wherein the transverse slot is formed at a slight angle and substantially parallel to a longitudinal axis of the cylindrical member, the transverse slot extending approximately from the juncture of the first side surface and the bottom side surface of the groove towards a first end of the cylindrical member.

7. The bottle opener of claim 1, wherein the bottom surface of the groove has a substantially planar surface that is substantially parallel to a longitudinal axis of the cylindrical member.

8. The maraca of claim 1, wherein the first side surface of the groove has a substantially planar surface, and extends from the bottom surface of the groove at an interior angle of approximately greater than 90°.

9. The maraca of claim 8, wherein the interior angle is approximately 115°.

10. The maraca of claim 1, wherein the second side surface of the groove has a substantially planar surface and extends from the bottom surface of the groove at an interior angle that is greater than 90°.

11. The bottle opener of claim 10, wherein the interior angle is approximately 145°.

12. The bottle opener of claim 1, wherein the groove is sized such that the distance between the first side surface and the second side surface of the groove corresponds to an approximate radius of the bottle cap.

13. The bottle opener of claim 1, wherein the first side surface of the groove is closer to the shell than the second side surface of the groove.

14. The bottle opener of claim 1, wherein the cylindrical member has an enlarged diameter portion for gripping and wherein the groove is provided in the enlarged diameter portion.

15. The bottle opener of claim 1, wherein the shell is provided at a first end of the cylindrical member, and wherein the first side surface is provided on a side of the grove that is proximate to the first end.

16. A bottle opener, comprising:

a substantially cylindrical member having an outer surface which forms a handle, the handle including:

a first end;

a second end;

a groove, located near the second end, extending transversely across the handle, the groove having a first side surface, a second side surface, a bottom surface, and a transverse slot, the transverse slot having closed ends and formed into the cylindrical member from the bottom surface; and a metal tool including:

a first portion extending along the first side surface of the groove, a second portion extending outward from the first side surface of the groove, and configured to engage a bottle cap, and a fourth portion extending from the bottom side surface, the fourth portion being received in the transverse slot, and having a tooth edge for engaging an interior wall of the transverse slot for securing the tool to the handle.

17. The bottle opener of claim 16, wherein the metal tool comprises a third portion extending from the first side surface along the bottom surface of the groove.

18. The bottle opener of claim 16, wherein the transverse slot is formed approximately perpendicular to a longitudinal axis of the cylindrical member.

19. The bottle opener of claim 16, wherein the metal tool is formed by bending a piece of metal to form the first portion and the second portion.

20. The bottle opener of claim 16, wherein the bottom surface has a transverse length greater than the width of the first portion of the tool, and wherein the bottom surface is undercut on a side of the transverse slot corresponding to the first portion of the tool, thereby forming ridges for locating the tool.

21. A bottle opener, comprising:

a substantially cylindrical member having an outer surface which forms a handle, the handle including:

a first end, a second end, a groove located near the second end, extending transversely across the handle, the groove having a first side surface, a second side surface, a bottom surface, and a transverse slot, the transverse slot being formed into the cylindrical member at a slight angle and substantially parallel to a longitudinal axis of the cylindrical member, the transverse slot extending approximately from the juncture of the first side surface and the bottom side surface of the groove towards a first end of the handle at a slight angle and parallel to a longitudinal axis of the cylindrical member, the transverse slot extending approximately from the juncture of the first side surface and the bottom side surface of the groove towards a first end of the handle; and a metal tool including:

a first portion extending along the first side surface of the groove, a second portion extending outward from the first side surface of the groove, and configured to engage a bottle cap, and a third portion extending from the first side surface and being received in the transverse slot.

22. The bottle opener of claim 21, wherein the third portion of the tool includes a tooth edge for engaging an interior wall of the transverse slot for securing the tool to the handle.

23. A maraca comprising:

a shell with pellets therein;

an elongated member having an outer surface which forms a handle, the handle including:

a groove extending across the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces, and configured to engage a bottle cap.

24. The maraca of claim 23, wherein the tool is composed of metal.

25. The maraca of claim 23, wherein the elongated member is substantially cylindrical.

26. The maraca of claim 23, wherein the slot extends along an axis which is approximately parallel to a longitudinal axis of the elongated member.

27. The maraca of claim 23, wherein the slot extends along an axis which forms an angle with a longitudinal axis of the elongated member that is less than 90°.

28. The maraca of claim 23, wherein the slot extends along an axis which forms an angle with a longitudinal axis of the elongated member that is greater than 0°.

29. The maraca of claim 23, wherein the first portion of the tool and the second portion of the tool are substantially parallel to one another.

30. The maraca of claim 23, wherein the plurality of surfaces includes a first side surface a second side surface, and a bottom surface.

31. The maraca of claim 30, wherein the particular one of the plurality of surfaces is the first side surface.

32. The maraca of claim 30, wherein the slot extends along an axis which forms an angle with respect to a longitudinal axis of the elongated member that is greater than 0°, the slot extending approximately from a juncture of the first side surface and the bottom side surface of the groove towards an end of the elongated member.

33. The maraca of claim 30, wherein the groove is dimensioned such that the distance between the first side surface and the second side surface of groove approximately corresponds to a size of a radius of the bottle cap.

34. The maraca of claim 30, wherein the first side surface of the groove is closer to the shell than the second side surface of the groove.

35. The maraca of claim 23, wherein the first portion extends along a first axis, and wherein the second portion extends along a second axis which is substantially parallel to the first axis.

36. A maraca handle comprising:

an elongated maraca handle member having an outer surface which forms a holding portion, the holding portion including:

a plurality of surfaces on the elongated member forming a groove which includes a slot, the slot being formed into the elongated member from a particular one of the surfaces; and a tool including:

a first portion extending from the particular one of the plurality of surfaces, the first web portion being received in the slot, and a second portion extending outwardly from the particular one of the plurality of surfaces, and configured to engage a bottle cap.

37. The maraca handle of claim 36, wherein the tool is composed of metal.

38. The maraca handle of claim 36, wherein the elongated member is substantially cylindrical.

39. The maraca handle of claim 36, wherein the slot extends along an axis which is approximately parallel a longitudinal axis of the elongated member.

40. The maraca handle of claim 36, wherein the slot extends along an axis which forms an angle with a longitudinal axis of the elongated member that is less than 90°.

41. The maraca handle of claim 36, wherein the slot extends along an axis which forms an angle with a longitudinal axis of the elongated member that is greater than 0°.

42. The maraca handle of claim 36, wherein the first portion of the tool and the second portion of the tool are substantially parallel.

43. The maraca handle of claim 36, wherein the first portion extends along a first axis, and wherein the second portion extends along a second axis which is substantially parallel to the first axis.

44. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein the first portion is integral with the second portion.

45. The bottle opener of claim 44, wherein the elongated member is substantially cylindrical.

46. The bottle opener of claim 44, wherein the slot is a transverse slot.

47. The bottle opener of claim 44, wherein the slot extends along an axis which forms an angle with a longitudinal axis of the elongated member that is less than 9°.

48. The bottle opener of claim 44, wherein the slot extends along an axis which forms an angle with a longitudinal axis of the elongated member that is greater than 0°.

49. The bottle opener of claim 44, wherein the surfaces include a first side surface, a second side surface and a bottom surface.

50. The bottle opener of claim 49, wherein the particular one of the surfaces is the first side surface.

51. The bottle opener of claim 49, wherein the groove is dimensioned such that a distance between the first side surface and the second side surface of the groove approximately corresponds to a size of a radius of the bottle cap.

52. The bottle opener of claim 44, wherein the first portion extends along a first axis, and wherein the second portion extends along a second axis which is substantially parallel to the first axis.

53. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein the slot extends along an axis which is approximately parallel to a longitudinal axis of the elongated member.

54. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein the first portion and the second portion of the tool are substantially parallel to one another.

55. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein the slot extends along an axis which forms an angle with to a longitudinal axis of the elongated member that is greater than 0°, the slot extending approximately from a juncture of a first side surface and a bottom side surface of the surfaces of the groove towards an end of the elongated member.

56. The bottle opener of claim 55, wherein the first side surface of the groove is further from the first end of the elongated member than the second side surface of the groove.

57. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein a bottom surface of the surfaces of the groove has a substantially planar surface that is substantially parallel to a longitudinal axis of the cylindrical member.

58. A bottle opener comprising:

an elongated member having an outer surface which forms a holding member, the holding member including:

a groove extending along at least a portion of the handle, the groove including a plurality of surfaces and a slot, the slot extending into the elongated member from a particular one of the plurality of surfaces; and a tool including:

a first portion extending from the particular one of the plurality of surfaces, the first portion being received in the slot, and a second portion extending outwardly from the particular one of the plurality of surfaces of the groove, and configured to engage a bottle cap, wherein a first side surface of the surfaces of the groove has a substantially planar surface, and extends from a bottom surface of the surfaces of the groove at an interior angle of approximately greater than 90°.

59. The bottle opener of claim 58, wherein the interior angle is approximately 150°.

60. The bottle opener of claim 58, wherein the second side surface of the groove has a substantially planer surface and extends from the bottom surface of the groove at an interior angle that is greater than 90°.

61. The bottle opener of claim 60, wherein the interior angle is approximately 145°.

62. A maraca handle comprising:

an elongated member having an outer surface which forms a holding member, the holding member including:

a groove extending along at least a portion of the handle, the groove including a plurality of surfaces, a first surface of the surfaces being substantially planar, a second surface of the surfaces being substantially planar, the first surface being immediately adjacent to the second surface of the surfaces; and a tool including a first portion extending along the first surface of the surfaces and a second portion provided at a predetermined distance from the first portion, the second portion provided for engaging a bottle cap and extending in a direction that is approximately parallel to the first surface.

63. The maraca handle opener of claim 62, wherein the tool includes a further portion extending along the second surface of the surfaces.

64. A bottle opener comprising:

an elongated member having an outer surface which forms a holding member, the holding member including:

a groove extending along at least a portion of the handle, the groove including a plurality of surfaces, a first surface of the surfaces being substantially planar, a second surface of the surfaces being substantially planar, the first surface being immediately adjacent to the second surface of the surfaces; and a tool including a first portion extending along the first surface of the surfaces and a second portion provided at a predetermined distance from the first portion, the second portion provided for engaging a bottle cap and extending in a direction that is approximately parallel to the first surface.

65. The bottle opener of claim 64, wherein the tool includes a further portion extending along the second surface of the surfaces.

* * * * *